United States Patent [19]

Voit

[11] Patent Number: 4,542,634

[45] Date of Patent: Sep. 24, 1985

[54] STAKING MACHINE

[76] Inventor: Karl Voit, Wunsiedler Strasse 39, D-8671 Weissenstadt, Fed. Rep. of Germany

[21] Appl. No.: 459,615

[22] Filed: Jan. 20, 1983

[30] Foreign Application Priority Data

Feb. 3, 1982 [DE] Fed. Rep. of Germany ..... 3203619

[51] Int. Cl.[4] ..... C14B 1/42; C14B 1/40

[52] U.S. Cl. ..... 69/34; 69/37; 69/41; 69/42; 69/43

[58] Field of Search ..... 69/34, 37, 41, 42, 45, 69/47

[56] References Cited

U.S. PATENT DOCUMENTS

| | | | |
|---|---|---|---|
| 977,132 | 11/1910 | Richter | 69/41 |
| 1,075,887 | 10/1913 | Whitney | 69/37 X |
| 1,117,227 | 11/1914 | Ormerod | 69/41 |
| 1,959,589 | 5/1934 | Loescher | 69/41 |
| 2,603,079 | 7/1952 | Borg | 69/37 |
| 3,552,157 | 1/1971 | Repetto | 69/42 |
| 3,911,703 | 10/1975 | Repetto | 69/37 |

FOREIGN PATENT DOCUMENTS

| | | | |
|---|---|---|---|
| 2756758 | 7/1978 | Fed. Rep. of Germany | 69/37 |
| 1280606 | 11/1961 | France | 69/42 |
| 1308609 | 10/1962 | France | 69/42 |
| 1554440 | 12/1968 | France | 69/34 |

*Primary Examiner*—Wm. Carter Reynolds
*Attorney, Agent, or Firm*—Michael J. Striker

[57] ABSTRACT

In a staking machine for staking leather, skins or furs a rotatable work roll carrying staking blades or grindstones is arranged against a flexible pressing device with an adjustable gap. A workpiece is pulled through the gap by a rotary feed roll and a rotary clamping roll also arranged at an adjustable clearance. The workpiece is fed through the gap between the feed roll and the clamping roll when the feed roll cooperates with the clamping roll.

9 Claims, 8 Drawing Figures

STAKING MACHINE

BACKGROUND OF THE INVENTION

The present invention relates to a staking machine for treating leather, skins and furs.

Conventional staking machines of the type under discussion include a rotary work roll provided with staking blades and/or grindstones on its circumference against which a pressing device is arranged for pressing a workpiece being treated and conveyed therebetween against the work roll. The workpiece pulled out from the work roll and pressing device cooperated therewith is staked or grinded. These otherwise satisfactory staking machines have been considered, however not sufficiently effective.

SUMMARY OF THE INVENTION

It is an object of the invention to provide an improved staking machine.

It is a further object of the invention to provide a staking machine in which a time period required for treating a leather or skin workpiece is significantly shortened.

It is still a further object of the invention to provide a staking machine in which the introduction and clamping of the workpiece in the machine will be simplified.

Still another object of the invention is to provide a staking machine which can be made autommatic in all operations.

These and other objects of the invention are attained by a staking machine for treating leather, skins, furs or the like, comprising at least one rotatable work roll provided with staking blades on a circumference thereof; at least one resilient pressing means arranged to form a gap with said work roll to receive a workpiece in said gap, said pressing means pressing the workpiece against said work roll; conveying means for pulling the workpiece between the pressing means and the work roll, said conveying means including at least one rotary feed roll and at least one rotary clamping roll arranged with said feed roll to form a clearance therebetween, the workpiece being introduced through said clearance and being conveyed through said gap when said clamping roll cooperates with said feed roll; and means for adjusting said clearance.

According to a further feature of the invention the clamping roll may be adapted to swing to and from the feed roll whereby said clearance is adjusted.

The work roll may be adapted to be shifted to and from the pressing means so that said gap is adjusted.

Furthermore, the staking machine of the invention may comprise two rotary work rolls arranged at opposite sides of said feed roll and spaced therefrom, and two resilient pressing means each associated with the respective work roll, each of said work rolls being driven independently from one another and being operated alternatingly, the workpiece being conveyed to each of the work rolls and the associated pressing means by said feed roll and said clamping roll in an alternating fashion.

According to still further modification of the invention the conveying means of the machine may comprise two clamping rolls arranged at opposite sides of the feed roll at 180° with respect thereto, the feed roll being switchable in two directions of rotation so that the workpiece is conveyed between one of said work rolls and the associated pressing means and then between another of said work rolls and the associated pressing means by said feed roll and the respective clamping roll. The conveying means may further include two additional rolls each connected to the respective clamping roll and a continuous conveyor belt mounted around the additional rolls, said clamping rolls and overlapping a portion of a circumference of the feed roll.

One of the clamping rolls may be mounted at the feed side of the staking machine, said one clamping roll and said conveyor belt being operable to swivel from an operating position in which said one clamping roll cooperates with said feed roll and an open position in which the workpiece is introduced into a feed gap formed between said feed roll and said conveyor belt.

According to a still further feature of the invention the one clamping roll and the additional rolls may be mounted on a mutual support, said support being operable to swivel about a central axis of one of the additional rolls to move said one clamping roller and said conveyor belt from said operating position to said open position and from said open position to said operating position.

The staking machine may further include a feed table having a transition belt thereon for introducing the workpiece to be treated into said feed gap between said conveyor belt and said feed roll when said conveyor belt is in said open position.

Each of the pressing means may comprise a revolving pressing roll having an axis parallel to an axis of the associated work roll.

The novel features which are considered as characteristic for the invention are set forth in particular in the appended claims. The invention itself, however, both as to its construction and its method of operation, together with additional object and advantages thereof, will be best understood from the following description of specific embodiments when read in connection with the accompanying drawing.

DETAILED DESCRIPTION OF THE PREFERRED EMBODIMENTS

Figure 1:
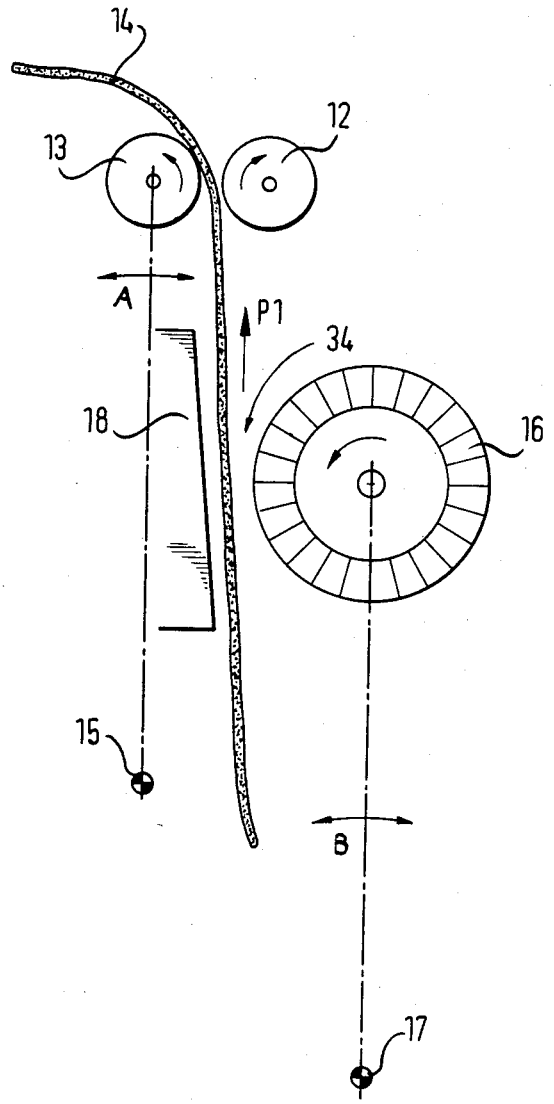
FIG. 1 is a schematic view of the first embodiment of the invention.

FIG. 1 schematically illustrates the basic principle of operation of a staking machine equipped with rolls. A workpiece 14, hereinafter referred to as leather, is guided between two rolls 12 and 13, of which, for example, roll 12 is a feed roll and roll 13 is a clamping roll which can be swivelled about a center of motion 15, towards and away from the feed roll in the directions of arrows A such that the leather 14 is clamped between two rolls 12 and 13.

The staking machine is also provided with a flexible, resilient pressing means such as resilient bar 18, against which can be pressed a work roll 16 which is provided in the known fashion with staking blades and/or grindstones. The work roll 16 can be swivelled about a center of motion 17, towards and away from the pressing means 18 as shown by arrows B. The swivelling and pressing motion of rolls 13 and 16, respectively, can be effected, for example by means of pneumatic piston cylinder units (not shown).

Leather is introduced with its fleshside facing towards the work roll 16 into a working gap 34 between work roll 16 and pressing bar 18 by means of rolls 12, 13. Then the work roll 16 is swivelled towards the pressing bar 18, thus causing the leather 14 to be pressed against the pressing bar 18. The clamping roll 13 is moved towards the roll 12 until the leather is clamped and held between the rolls 12 and 13. Then the rolls 12 and 16 are rotated by means of any conventional drive devices, such as electric motors, in which case the feed roll 12 rotates clockwise and the work roll 16 counterclockwise as shown by arrows in the drawings. Rolls 12, 13 then pull the leather upwardly in the direction of the arrow P1 and between the pressing bar 18 and the rotating work roll 16. During this movement, the leather 14 is staked in the known manner and is also ground if the work roll 16 is provided with grindstones.

After the leather 14 has passed through the rolls, it is turned up and the other side which has not yet been treated is introduced between the pressing bar 18 and the work roll 16, and this side is also treated in the same manner, i.e. staked.

Figure 2:
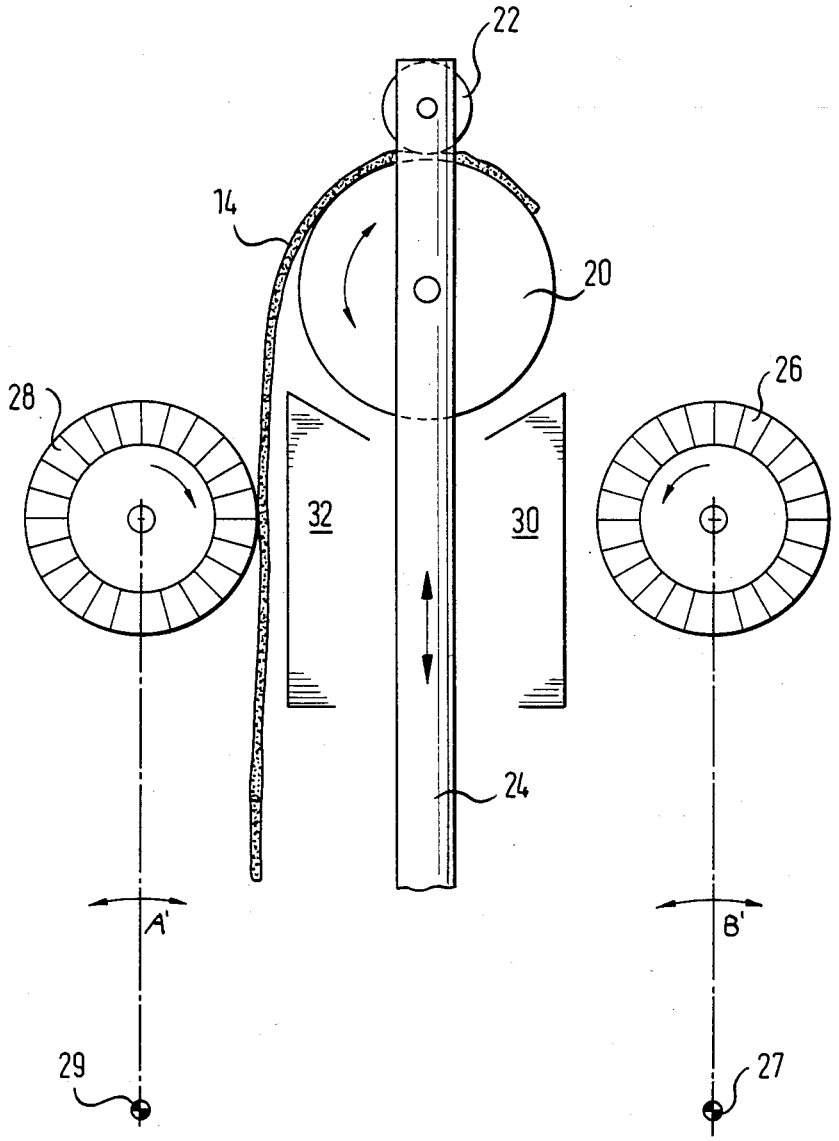
FIG. 2 is a schematic view of the second embodiment of the invention.

FIG. 2 shows a further development of the embodiment according to FIG. 1. In this example, two work rolls 26 and 28 are provided which can be driven independently of each other and of which the roll 26 can be swivelled about a center of motion 27 in the directions of arrows Bl and the roll 28 can be swivelled about a center of motion 29 in the directions of arrows A1, respectively towards and away from the pressing bars 30 and 32 respectively associated therewith. This swivelling and pressing motion against the resilient pressing bars 30 and 32 can be effected by means of pneumatic piston-cylinder unts (not shown).

In the embodiment shown, a feed roll 20 and a clamping roll 22 are provided, both of which are mounted on a lifting arm 24. As shown in the drawing, the feed roll 20 has a larger diameter, e.g. two or three times larger, than that of the clamping roll. The latter can be adjusted in the direction of the feed roll so that leather 14 can be held and conveyed between these two rolls. The adjustment of the clamping roll 22 can be carried out by means of a conventional pneumatic piston-cylinder unit (not shown). The feed roll 20 may be driven by means of an electric motor (not shown), for example. It can be switched to revolve in both directions of rotation.

Leather 14 is held between the rolls 20 and 22, and its lower portion guided between the work roll 28 and the pressing bar 32 hangs downwardly therefrom. Then the work roll 28 is swivelled towards the pressing bar 32 and is pressed against the latter. Then the work roll 28 is switched to rotate clockwise while the lifting arm 24 is moved upwardly by means of a drive device (not shown), for example a pneumatic piston-cylinder unit. During this movement, the portion of the leather 14 hanging downwardly from the point of contact between the work roll 28 and the pressing bar 32 is pulled upwardly between these two parts and is staked and/or ground by the work roll 28. After this step, the leather 14 is conveyed by means of the feed roll 20 and the clamping roll 22 to the area between the work roll 26 and the pressing device 30. This is effected by rotating the feed roll clockwise while at the same time lifting arm 24 is pulled downwardly to the position as shown. Then the work roll 26 is moved towards its pressing device 30 until the leather 14 is clamped between these two parts. The lifting arm 24 is again moved upwardly and the leather is held between the feed roll 20 and the clamping roll 22 such that it is pulled upwardly between the work roll 26 and the pressing bar 30 and is thereby staked and/or ground. This operation may be repeated several times.

In the modification shown in FIG. 2, the lifting arm 24 may be stationary while the feed of the leather 14 through the respective gap between the work rolls 26, 28 and the pressing bars 30, 32 is carried by means of the feed roll 20 and clamping roll 22 which are driven by a motor which can be switched to both rotational directions.

Figure 3:
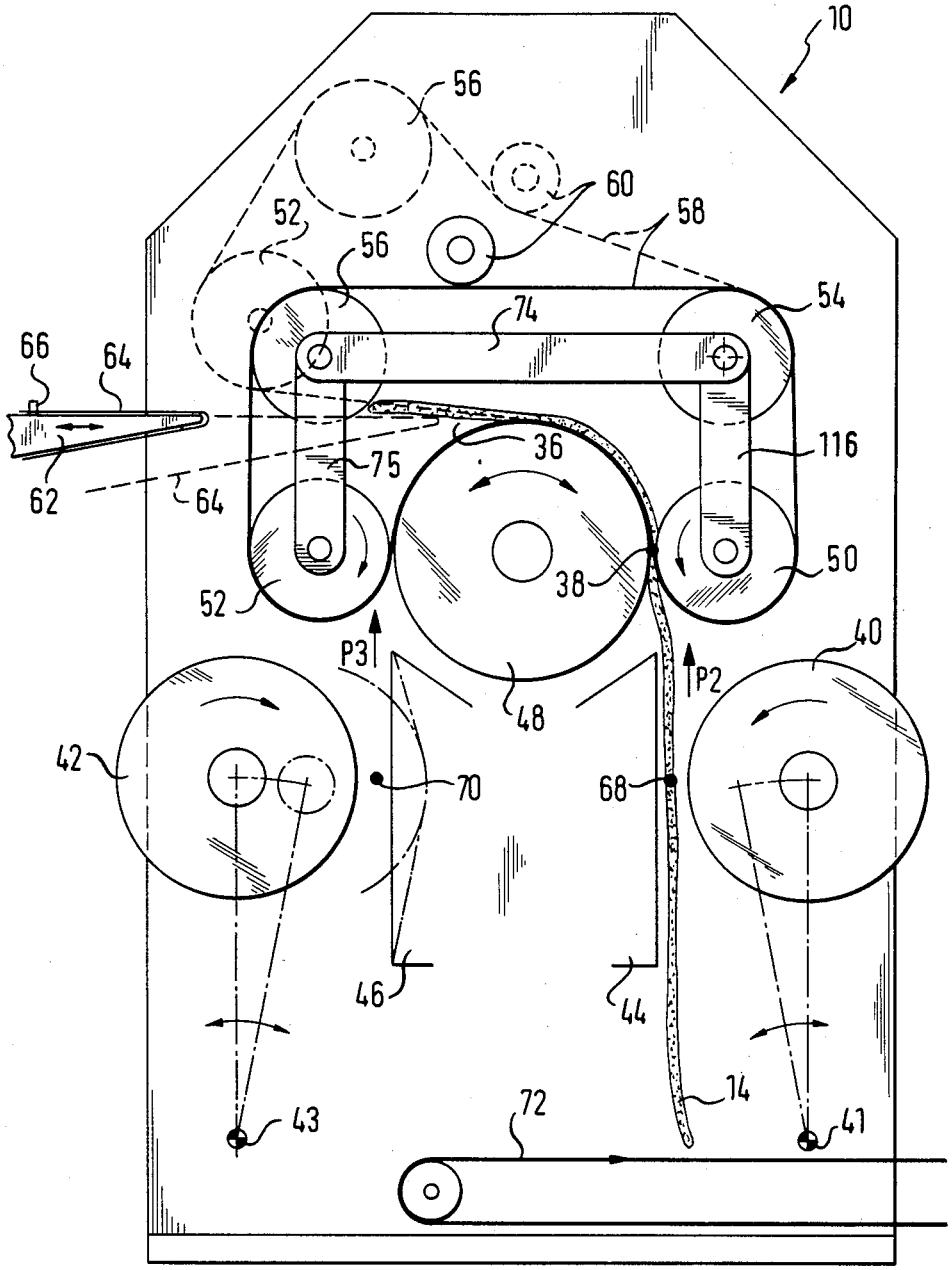
FIG. 3 is a schematic view of the staking machine in accordance with a further embodiment of the invention, which permits substantially automatic operation of the machine.

FIG. 3 schematically shows a preferred embodiment of the staking machine. This staking machine runs in continuous operation and is substantially automatic.

The staking machine 10 is provided with two work rolls 40, 42 provided with staking blades and/or grindstones conventional manner and two pressing devices 44, 46. The work roll 40 can be swivelled about a center of motion 41 and the work roll 42 can be swivelled about a center of motion 43 such that the rolls can be moved towards and away from their respective pressing devices, with the result that the leather 14 to be processed is caught and held between the work roll and the pressing device. The fleshside of the leather is faced towards the work roll. The machine is also provided with a feed roll 48, which can be switched to both rotational directions, and with two clamping rolls 50, 52, either of which is situated against the respective either side of the feed roll 48 such that the clamping rolls 50 and 52 are offset one relative to another substantially at 180°. The further rolls 54, 56 are provided, of which the roll 54 is driven synchronously with the feed roll 48. This may be carried out, for example, by means of a set of gears functionally switched between the feed roll 48 and the roll 54 and appropriately contacted with the two rolls. It is appropriate to drive the feed roll 48 by means of a motor (not shown).

A conveyor belt 58 is placed around the rolls 50, 54, 56, 52, and, as shown in FIG. 3, it is also wound about a portion of the circumference of the feed roll 48. In the position of the four rolls shown by continuous lines the winding angle of the belt amounts to about 180°, and it amounts only to about a little less than 90° in the position of the rolls 52 and 56 shown by broken lines.

A tension roller 60 holds the conveyor belt 58 taut all the time. The tension roller 60 may, for example, be loaded by means of a spring or weight.

The two clamping rolls 50 and 52 can be pressed singly and jointly against the feed roll 48 and moved away from it again by means of pneumatic piston-cylinder units (not shown), such that the leather 14 can be held between the feed roll 48 and the respective clamping roll 52 or 50, as illustrated in the case of the clamping roll 50, for example.

A feed table 62 is only schematically shown at the feed side of the staking machine 10. A transition belt 64 runs over and about the table 62. The feed table 62 is also provided with a mark 66 fixed thereto.

Rolls 54 and 56 are supported on a mutual support 74, and roll 52 is connected to roll 56 by means of a bracket 75 such that two rolls 56 and 52 can be swivelled from the position about the central axis of the roll 54, shown by continuous lines, to the position shown with broken lines.

The staking machine 10 according to FIG. 3 operates as follows:

Two rolls 56 and 52 are swivelled from their operating position into the open position (shown by broken lines). The leather to be processed is placed on the feed table 62 or on the transition belt 64 running across the table, in such a manner that a given point on the leather coincides with the fixed mark 66. Then the feed table 62 is moved to the right to the position shown by broken lines. It enters a feed gap 36 between the conveyor belt 58 and the outer surface of the feed roll 48.

Then transition belt 64 and the conveyor belt 58 are switched on. The feed roll 48 rotates clockwise and leather 14 is pulled from the table 62 and conveyed between the conveyor belt 58 and the feed roll 48 until the point on the leather 14, which was beside the mark 66, reaches a clamping point 38, i.e. the point of contact between the feed roll 48 and the clamping roll 50.

This path is always the same independently of the size of the leather to be treated. This means that the leather will hang downwardly from the clamping point 38 to a greater or lesser extent depending on its size.

The treatment of the leather does not, however, begin at the clamping point 38 but at an operating point 68, i.e. at the point of contact between the work roll 40 and the pressing device 44.

In the meantime, the table 62 is returned to its starting position shown in the drawing by continuous lines and rolls 56 and 52 are swivelled to their operating position also indicated in FIG. 3 by continuous lines.

The work roll 40 is then swivelled about its center of motion 41 towards the pressing device 44, and the leather is pressed by the work roll 40 against the pressing device 44. Since the latter is flexible and resilient, it yields to the left (in the plane of the drawing) in conjunction with the work roll 42.

Then feed roll 48 is set in motion and rotates counterclockwise while the roll 54 is rotating synchronously. The leather is thereby conveyed upwardly in the direction of the arrow P2 between the feed roll 48 and the conveyor belt 58 and is pulled between the work roll 40 and the pressing device 44. During this upward motion, the leather is staked and also ground if the roll 40 is also equipped with grinding blades. Thus the portion of the leather 14 hanging downwardly from the operation point 68 is treated.

The feed roll 48 and the conveyor belt 58 are then operated until the point on the leather, which was at the operating point 68 at the beginning of the treatment, has been conveyed around the feed roll 48 to the operating point 70, i.e. the point of contact between the work roll 42 and the pressing device 46 associated therewith. The portion of leather 14 not yet processed then hangs downwardly from the operating point 70, while the portion of leather 14 which has just gone through the treatment is conveyed upwardly from the operating point 70 and is partly situated between the conveyor belt 58 and the outer surface of the feed roll 48. The work roll 42 is now swivelled about its center of rotation 43 towards the pressing device 44 until the leather is clamped between the latter and roll 42, i.e. roll 42 presses the leather against the pressing device 46. Then the feed roll 48 (and along with it the roll 54) is switched on again, but this time the feed roll 48 rotates clockwise. The leather, whose treated section is at least partly between the roll 48 and the belt 58, is conveyed upwardly in the direction of arrow P3 and is pulled between the work roll 42, which now rotates clockwise, and the pressing device 46. The leather is thereby staked and/or ground. Work roll 40 is deactivated when roll 42 is rendered active.

When the portion of the leather 14 which previously hung downwardly from the operating point 70 has passed through the roll 42 and pressing device 46 completely, the leather is completely processed and can be conveyed further until it comes to rest on a conveyor belt 72 which transports it out and away from the staking machine. The staking process may, however, be repeated several times by switching over the feed roll 48 and the conveyor belt 58.

It has been already mentioned that the leather is conveyed during and after the first process step until its point which was originally at operating point 68 reaches the operating point 70. In the case of large pieces of leather or skins being treated, it may happen that the section of the leather 14 hanging downwardly from the operating point 68 is so long that this portion will not have been processed completely when the point 68 has been moved to the point 70. This will always be the case if the section of the leather hanging down from the point 68 is longer than the distance from the operating point 68 via the feed roll 48 to the operating point 70. Although the operating point 68 has already reached the point 70, the work roll 40, which rotates counterclockwise, is still in contact with pressing device 44 and still treats a further piece of leather 14.

In this case, the feed roll 48 continues to rotate until the complete piece of the leather being processed which originally hung downwardly from the operating point 68 is treated by the work roll 40. When this piece of leather has passed through the gap between the work roll 40 and the pressing device 44 and the work roll 40 no longer takes any resistance, the torque decreases and both the work roll 40 and, in particular, the feed roll 48 and the belt 58 are switched off by means of an appropriate torque switch.

As described above, the work roll 42 is now brought into contact with the leather 14 and is switched on, and at the same time feed roll 48 and belt 58 are switched over with the result that, as above, the portion of the leather,that has not yet been treated, is staked. In this instance, however, the leather 14 overlaps during staking because the portion that has already been staked by the work roll 40 is now staked a second time by the work roll 42 because the starting point of the leather, which was at the operating point 68 as the treatment began, is now somewhat below the operating point 70, with the result that a portion of leather corresponding to the amount defined by the position of the original point 68 being below the point 70, is processed twice It has been explained above that the unfinished leather is placed on the work table 62 such that a certain point on the leather is at the mark 66 and this point comes to rest at the clamping point 38 after the introduction of the leather between belt 58 and feed roll 48. This ensures that each time leather is introduced into the staking machine it reaches the same starting point for finishing. However, it is also possible to arrange the mark 66 in such a way that a certain point on the leather, preferably at the middle thereof, comes to rest at the mark 66 when it is placed on the table 62. In other words, the leather can be placed in such a manner on the table that the middle or middle line of the leather to be treated would lie at the mark 66. In this case the leather may be conveyed into the staking machine until the point or line on the leather, which was originally at the mark 66, comes to rest at the operating point 68, so that starting from the middle of the leather, one half of the leather is finished by the work roll 40 and then the other half is processed by the work roll 42.

It was also mentioned above that the two clamping rolls 50 and 52 can be adjusted separately towards the feed roll 48 in order to clamp the leather between the feed roll and the clamping roll associated therewith.

For this purpose, the clamping roll 50 can be adjusted independently by means of a suitable individual (not shown) piston-cylinder unit since it is pivoted independently of the three other rolls 54, 52 and 56. Rolls 52 and 56 are, however, pivoted on support 74 and bracket 75 associated therewith in order to be able to be swivelled together from the operating position to the open position. If clamping roll 52 is to be moved further towards the feed roll 48 and pressed against it so as to obtain a greater clamping effect, this can be achieved by appropriately pivoting the clamping roll 52 on the bracket 75, for example by means of a suitable elongated hole for the pivot.

Figure 4:
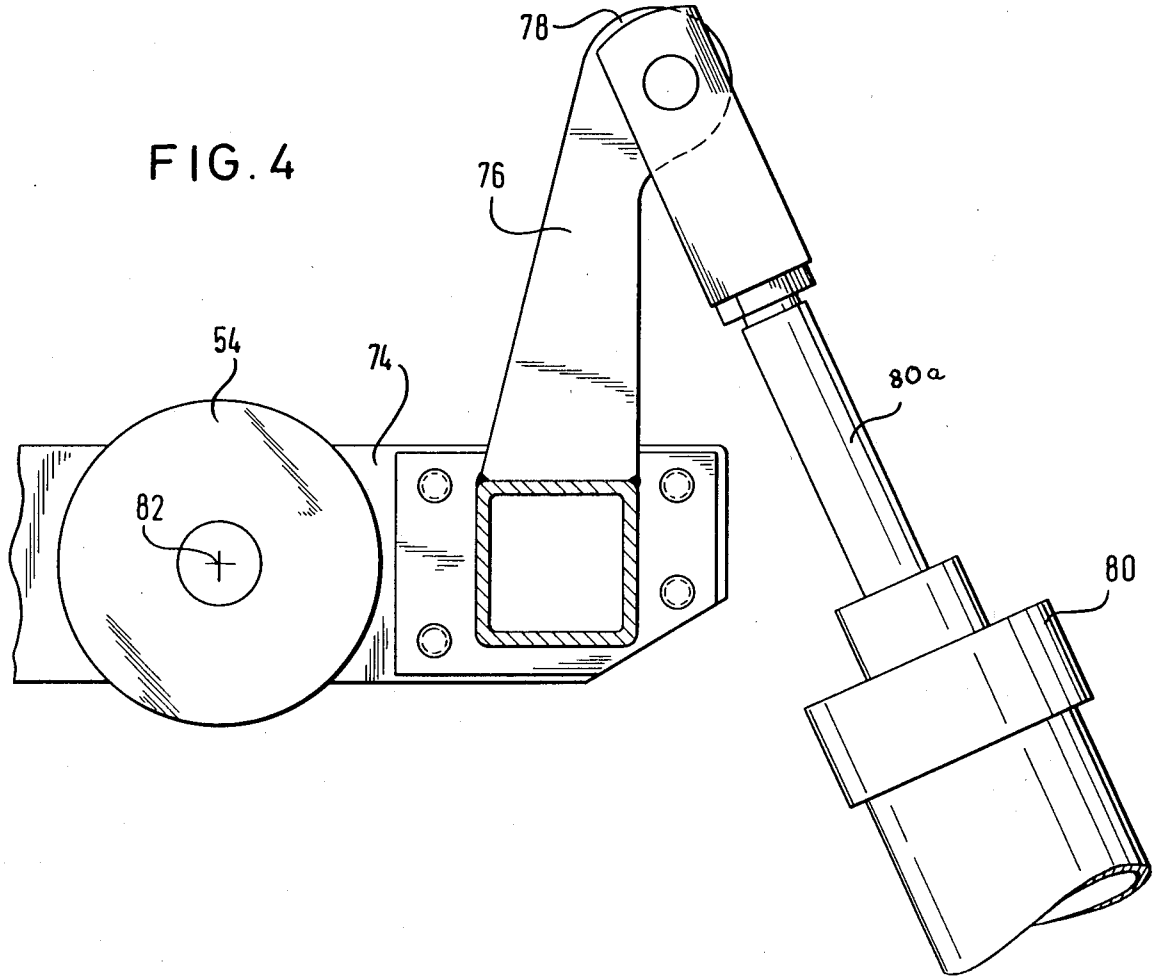
FIG. 4 is a schematic view of a device for swivelling of a support of the staking machine of FIG. 3.

FIG. 4 shows a device for swivelling support 74 about a central axis 82 of roll 54 in detail. Support 74 is provided with a lever arm 76 rigidly connected thereto. A pneumatic piston cylinder unit 80, known per se, engages a free end 78 of lever arm 76. At the position shown in FIG. 4, the piston 80*a* of the unit 80 is extended and support 74 is in the operating position together with rolls 52 and 56 not shown in FIG. 4. If, on the other hand, the piston 80*a* of the unit 80 is retracted, the lever arm 76 is swivelled clockwise about the axis 82 and support 74 and rolls 52 and 56 attached thereto are swivelled therealong. The other end of the unit 80 not shown in FIG. 4 is attached to a fixed point on the housing of the machine.

Figure 5:
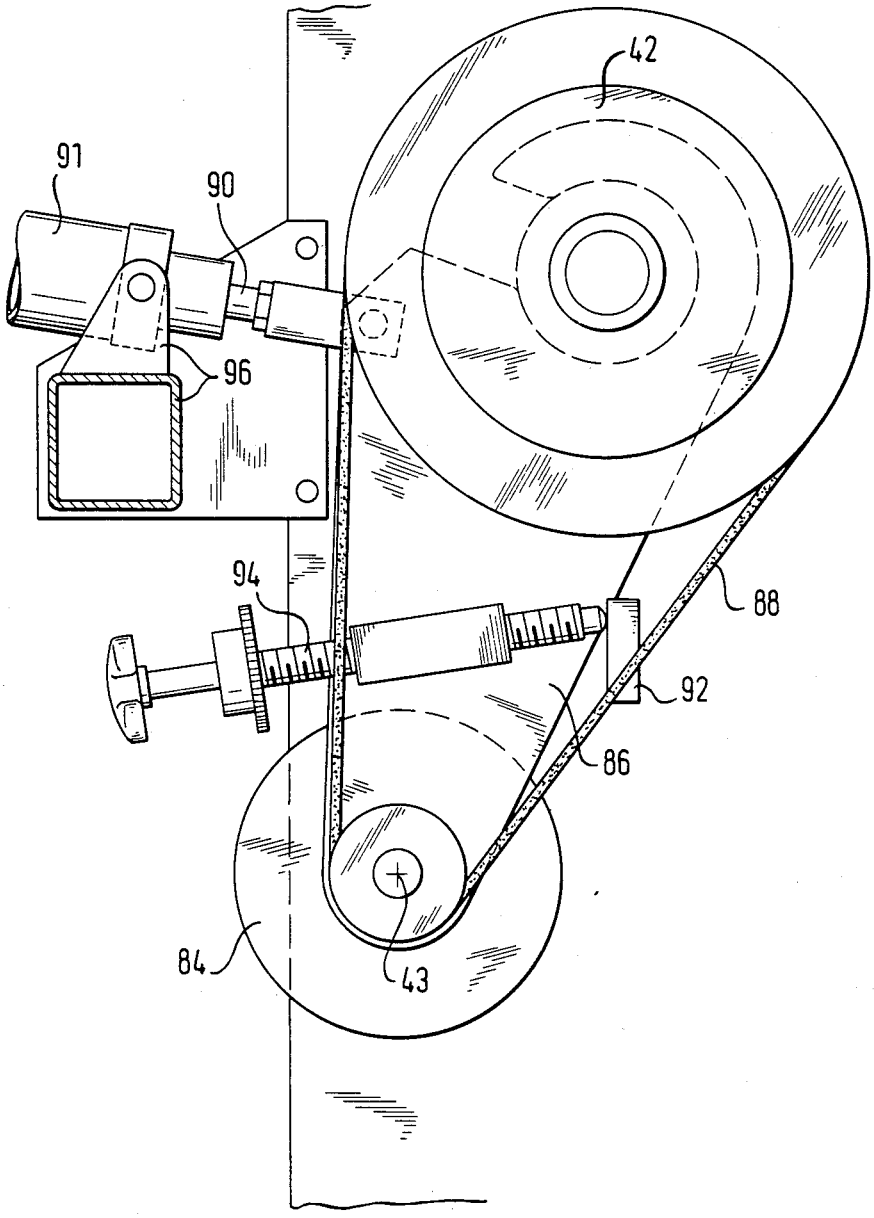
FIG. 5 is a schematic view of a drive for a work roll of the staking machine of FIG. 3.

FIG. 5 is a detail view of a device for swivelling of the work roll 42. The swivelling of the work roll 40 is carried out in an analogous fashion.

As seen in FIG. 5, work roll 42 is driven by an electric motor 84 by means of V-belts 88, for example. The work roll 42 is pivoted on an oscillating crank 86 which can be swivelled about the center of motion 43 coinciding with the central axis of the electric motor 84. A pneumatic piston-cylinder aggregate 90, 91 serves for operating the oscillating crank 86. The piston is attached to the oscillating crank and the cylinder 91 is attached to a holder 96 fixed to the housing of the machine. Depending on how far the piston 90 is extended out of the cylinder 91, the work roll 42 will be pressed correspondingly to a greater or lesser extent against the pressing device 46.

By means of a stop 92 attached to the housing or the frame of the machine and an adjustable stop screw 94, which is attached to the oscillating crank 86, the limit of travel of the work roll 42 can be set as required.

The work roll 42 is driven by V-belts 88. However, other drive means, e.g. gears, between motor 84 and roll 42 may be provided instead.

Figure 6:
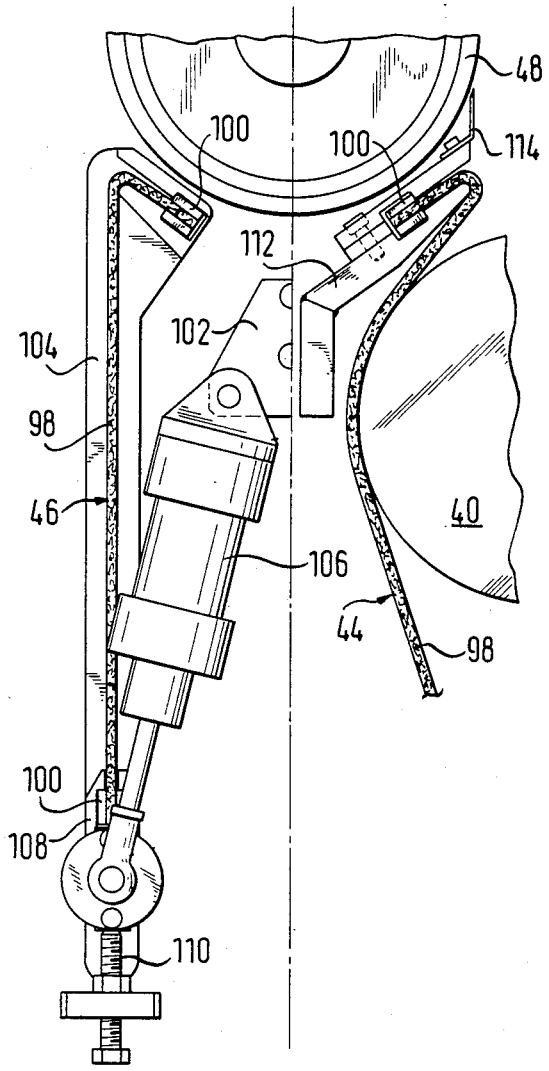
FIG. 6 is a schematic view of a pressing device of the staking machine of the invention.

FIG. 6 is a schematic view of the pressing devices 44 and 46. The pressing device consists of a pressing leather (or strip or pad or belt) 98 of leather or suitable plastics material. As shown at the left of FIG. 6, the pressing leather 98 is held at its upper and lower ends in respective shoes 100. The upper shoe 100 is attached to the frame or housing of the machine so as to be stationary.

The lower shoe 100 is supported in a slide 108 which is connected to one end of a pressure spring means 106, the other end of which is attached to a tie plate 102 fixed to the housing or frame. In the embodiment illustrated, the spring means 106 is embodied as a pneumatic piston-cylinder unit comprising a piston 107 and cylinder 105 which continuously endeavours to apply pressure to the pressing leather 98.

The slide 108 is movingly guided in a slot 104 formed for example in the machine frame or any other stationary element, and its limit or travel can be set by means of an adjustable stop screw 110 limiting the path of travel of piston 107. The slide 108 is guided, for example by means of a bearing or roller running in the slot 104 in a generally known fashion.

The manner in which the work roll 40 is pressed against the pressing leather 98 is shown at the right side of FIG. 6. The upper shoe 100, in which the upper end of the pressing leather 98 is held, is fixed on a shackle 112 fixed to the frame of the machine. The shackle 112 is provided with a deflector 114. The leather 14 coming from feed roll 48 slides past the deflector 114 and is guided with certainty into the operating area between the work roll 40 and the pressing leather 98.

The staking machine according to the invention can be controlled either electrically or electronically.

The operator should not do too much besides placing the leather 14 to be finished on the feed table 62 and transition belt 64 with the fleshside facing upwardly and observing the mark 66. After the machine is switched on, all further finishing steps are carried out automatically including the disposal of the finished leather coming from the staking machine. The machine thus runs in continuous operation.

Since the conveyor means is a rotating system, all required lengths of leather and skins can be processed and the finishing process can be repeated as often as desired so as to automatically stake and finish the leather intensively on both sides.

In FIG. 6 the pneumatic spring means 106 is embodied so as to have a pressing tendency, i.e. it endeavours to press the slide 108, whereby the pressing leather 98 is placed under pressure. However, it is also possible to apply the pneumatic spring means 106 so as to operate conversely, i.e. so as to exert a pull force on the slide 108. In this example (not shown), the end 105 of the pneumatic spring means 106 is swivelled about 140° or 150° downwardly and is pivotally mounted to a tie plate 102 attached to a suitable portion of the housing or frame of the machine in the manner as shown in FIG. 6.

As already mentioned, the pressing leather 98 may consist of a plastics material, e.g. an elastomer. Gummite or a rubber-like material may also be used.

In the example described above, the work rolls 42 and 40 are arranged so as to swivel about the centers of motion 43 and 41. The work rolls 16, 26 and 28 shown in FIGS. 1 and 2 can also be swivelled about the corresponding centers of motion 17, 27 and 29, respectively. On the other hand, the work rolls may also be made stationary and the respective pressing devices 18, 30, 32, 44, 46 will then be made movable, e.g. mounted so as to slide or swivel and press against the work rolls associated therewith.

As FIG. 3 shows, clamping roll 52 is connected to roll 56 by means of the bracket 75. In a corresponding manner, clamping roll 50 is connected to the driven roll 54 by means of a bracket 116. The two brackets 75 and 116 can be swivelled to a limited angle about the axes of rollers 52 and 54, respectively, and an appropriate stop (not shown) can be used for limiting the swivel angle, with the result that clamping rolls 52 and 50 will be pendulously arranged.

Clamping rolls 50 and 52 can be operated independently of each other and pressed against the feed roll 48 by means of piston-cylinder units (not shown).

Figure 7:
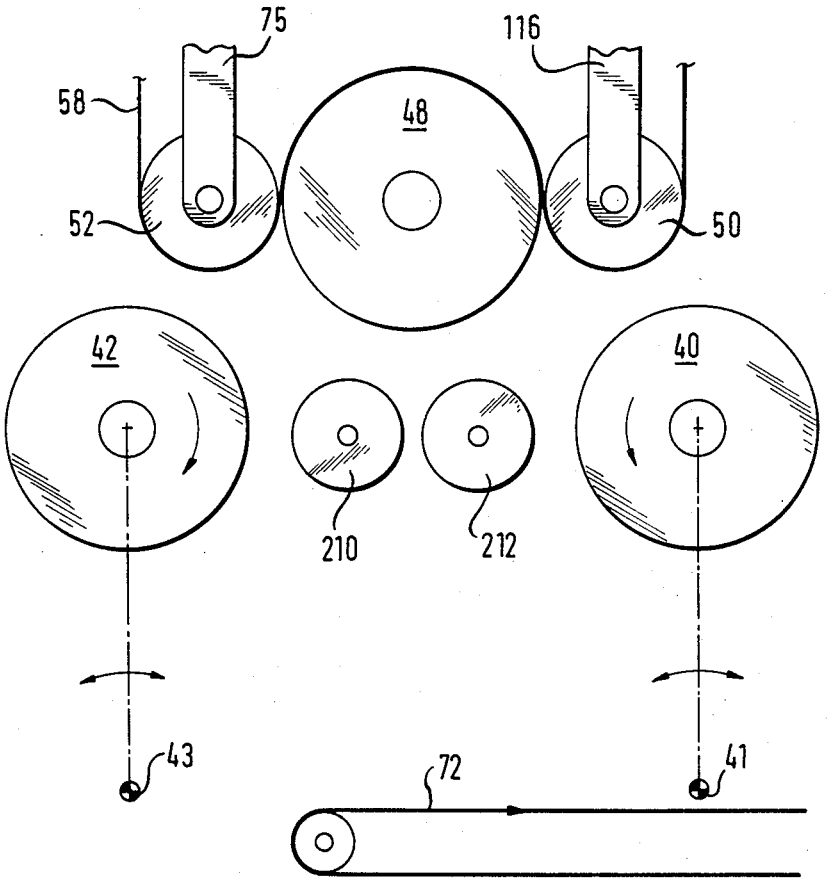
FIG. 7 is a schematic view of another embodiment of the pressing device.

FIG. 7 shows a further embodiment of the pressing devices. Loosely revolving pressing rolls 210, 212 made of hard rubber are used instead of pressing leather 98. The axes of the pressing rolls 210, 212 are parallel to the axes of work rolls 40 and 42. During operation, the work rolls 40 and 42 are swivelled as described in conjunction with FIG. 3, and work rolls 42 and 40 are pressed against the pressing rolls 210 and 212, respectively. The leather 14 to be finished is, as also described in conjunction with FIG. 3, pulled between each work roll and the pressing roll associated therewith.

The pressing rolls 210, 212 are fixedly mounted to the machine frame, but they can also be movably mounted in the machine and pressed against the work rolls 40, 42, for example by means of pneumatic piston-cylinder units (not shown).

Figure 8:
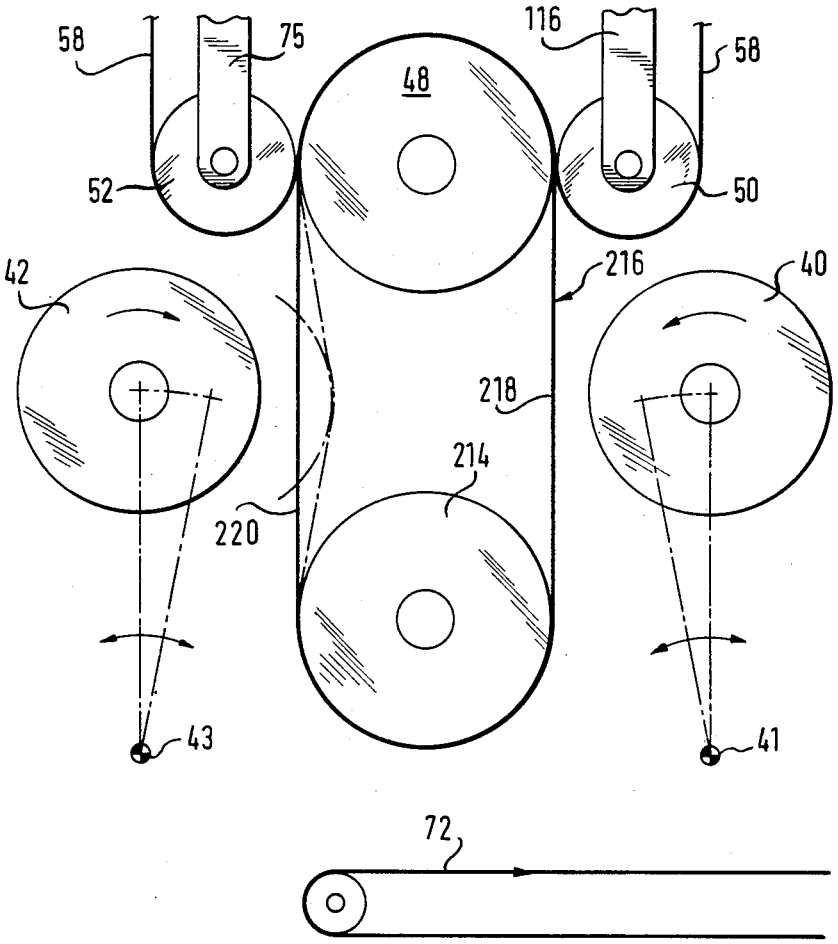
FIG. 8 is a schematic view of a pressing device according to still another embodiment.

FIG. 8 shows a still further embodiment of the pressing devices. In this example, a continuous belt 216 is used instead of the pressing leather. The belt 216 runs over the feed roll 48 and a back-up roll 214 revolving loosely therewith and spaced a distance from the feed roll 48.

As explained in conjunction with FIG. 3, work rolls 40 and 42 are pressed during operation against the belt sections 218 and 220, respectively, associated therewith. The tension of the belt 216 can be adjusted by means of a pneumatic piston-cylinder unit (not shown), one end of which can be attached to the frame of the machine and the other end of which would be attached to the back-up roll 214. Belt 216 is driven by the feed roll 48.

Apart from staking, the machine may also be used for scouring and fleshing and also for smoothing skins or leathers. In the latter case, smooth, cylindrical rolls are used as work rolls. They have a polished chromium surface which is heated from within and are pressed against the leather (or skin, or fur) being treated, just as in the embodiments described above.

It will be understood that each of the elements described above, or two or more together, may also find a useful application in other types of staking machines differing from the types described above.

While the invention has been illustrated and described as embodied in a staking machine, it is not intended to be limited to the details shown, since various modifications and structural changes may be made without departing in any any from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A staking machine for treating leather, skins, furs or the like, comprising two rotatable work rolls each provided with staking blades on a circumference thereof; two resilient pressing means each associated with a respective work roll and spaced from the respective work roll to form a work gap and receive a workpiece in said work gap; conveying means for pulling the workpiece between each pressing means and the respective work roll; said conveying means comprising at least one rotary feed roll and two rotary clamping rolls arranged at opposite sides of said feed roll at 180° with respect thereto and for cooperation therewith so as to form a feed gap for receiving the workpiece between said feed roll and an associated clamping roll, said two rotatable work rolls and said two resilient pressing means being arranged at opposite sides of said feed roll, each of said work rolls being driven independently from one another and being operated alternatingly and the workpiece being conveyed to each of the work rolls and the associated pressing means by said feed roll and each clamping roll in an alternating fashion, said feed roll being switchable in both directions of rotation so that the workpiece is conveyed between one of said work rolls and the associated pressing means and then between another of said work rolls and the associated pressing means by said feed roll and the respective clamping roll whereby the workpiece is staked during its conveying movement, each work roll being adapted to be shifted to and from the associated pressing means so that the work gap between each work roll and the associated pressing means is adjusted, said conveying means further including two additional rolls connected to each other and each connected to the respective clamping roll, and a continuation conveyor belt mounted around said additional rolls and said clamping rolls and overlapping a portion of a circumference of said feed roll.

2. The machine as defined in claim 1, having a feed side, one of said clamping rolls being mounted at said feed side, said one clamping roll and said conveyor belt being operable to swivel between an operating position in which said one clamping roll cooperates with said feed roll and an open position in which the workpiece is introduced between said feed roll and said conveyor belt.

3. The machine as defined in claim 2, wherein one of said additional rolls has a central axis, said one clamping roll and said additional rolls being mounted on a mutual support, said support being operable to swivel about said central axis to move said one clamping roller and said conveyor belt from said operating position to said open position and from said open position to said operating position.

4. The machine as defined in claim 3, further including a feed table having a transition belt thereon for introducing the workpiece to be treated between said conveyor belt and said feed roll when said conveyor belt is in said open position.

5. The machine as defined in claim 4, wherein said feed table is provided with a fixed mark.

6. The machine as defined in claim 1, wherein each of said pressing means comprises a revolving pressing roll having an axis parallel to an axis of the associated work roll.

7. The machine as defined in claim 1, wherein said two pressing means are formed by a continuous belt and a back-up roll, said continuous belt passing over said feed roll and said back-up roll loosely revolving therewith.

8. The machine as defined in claim 1, further comprising means for applying tension to each of said two pressing means.

9. The machine as defined in claim 8, wherein said tension-applying means include a piston-cylinder unit.

* * * * *